United States Patent [19]

Kitaguchi et al.

[11] Patent Number: 4,546,075

[45] Date of Patent: Oct. 8, 1985

[54] HEAT-DEVELOPABLE PHOTOGRAPHIC MATERIAL

[75] Inventors: Hiroshi Kitaguchi; Isamu Itoh; Itsuo Fujiwara; Yasushi Nozawa; Tadayoshi Kokubo, all of Kanagawa, Japan

[73] Assignee: Fuji Photo Film Co., Ltd., Kanagawa, Japan

[21] Appl. No.: 530,822

[22] Filed: Sep. 9, 1983

[30] Foreign Application Priority Data

Sep. 9, 1982 [JP] Japan ..... 57-157197
Sep. 27, 1982 [JP] Japan ..... 57-168184

[51] Int. Cl.[4] ..... G03C 1/34

[52] U.S. Cl. ..... 430/617; 430/618; 430/619; 430/620

[58] Field of Search ..... 430/617, 618, 619, 620

[56] References Cited

U.S. PATENT DOCUMENTS

| | | | |
|---|---|---|---|
| 3,707,377 | 12/1972 | Tiers et al. | 430/619 |
| 3,874,946 | 4/1975 | Costa et al. | 430/617 |
| 3,877,940 | 4/1975 | Ericson | 430/617 |
| 4,108,665 | 8/1978 | Gutman et al. | 430/617 |
| 4,188,226 | 2/1980 | Akashi et al. | 430/620 |
| 4,442,202 | 4/1984 | Shiga et al. | 430/619 |
| 4,452,885 | 6/1984 | Nozawa et al. | 430/618 |
| 4,459,350 | 7/1984 | Przezdziecki | 430/619 |

FOREIGN PATENT DOCUMENTS

| | | |
|---|---|---|
| 70543 | 6/1981 | Japan . |
| 99335 | 8/1981 | Japan . |

*Primary Examiner*—Mary F. Downey
*Attorney, Agent, or Firm*—Sughrue, Mion, Zinn, Macpeak, and Seas

[57] ABSTRACT

A heat-developable photographic material comprising (a) an organic silver salt, (b) a photocatalyst, (c) a reducing agent, (d) a binder, and (e) at least one compound selected from the compound represented by the general formula (I) described below and the compound represented by the general formula (II) described below.

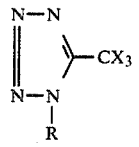

(I)

wherein X represents a halogen atom; and R represents a hydrogen atom, an alkyl group, an aryl group, an aralkyl group, an acyl group, a carbamoyl group, an alkylsulfonyl group, an arylsulfonyl group, an aralkylsulfonyl group or a heterocyclic residue,

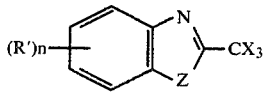

(II)

wherein X represents a halogen atom; Z represents a sulfur atom, an oxygen atom or $>N—R_1$ (wherein $R_1$ represents an alkyl group, an aryl group or an acyl group; (R')n represents a substituent present on the benzene nucleus; and n represents 0 or an integer from 1 to 4.

In the heat-developable photographic material, the occurrence of fog is prevented by using the compound represented by the general formula (I) or (II) which has reduced toxicity.

31 Claims, No Drawings

HEAT-DEVELOPABLE PHOTOGRAPHIC MATERIAL

FIELD OF THE INVENTION

The present invention relates to a heat-developable photographic material and, more particularly, to a heat-developable photographic material which prevents the occurrence of fog.

BACKGROUND OF THE INVENTION

A photographic process using silver halide has photographic properties, such as sensitivity, gradation, resolution, etc. which are superior to other means of photographic reproduction such as electrophotography, diazo photography, etc. Because of these superior properties, it has been the most prevailing type of photographic process. Recently, various techniques for simply and rapidly producing an image have been developed. These techniques involve changing the method for processing latent images formed in photographic materials of silver halide-using type from the conventional wet developing method using a developing solution or the like to the dry developing method using a heating means or the like.

The most successful examples in the art of photographic materials of the kind which can produce photographic images using such a dry processing method as described above are at present heat-developable photographic materials such as those described in U.S. Pat. Nos. 3,152,904 and 3,457,075. These heat-developable photographic materials utilize compositions which contain, as essential components, an organic silver salt, a catalytically small amount of photocatalyst (e.g., silver halide) and a reducing agent, respectively. These photographic materials are stable at ordinary temperatures. However, when heated to a temperature of about 80° C. or higher, and preferably 100° C. or higher, after imagewise exposure, the photographic material produces silver through a redox reaction of the organic silver salt, which can act as an oxidizing agent, with the reducing agent which takes place in its light-sensitive layer by the catalytic action of the exposed photocatalyst present in the neighborhood of the above-described agents. The silver which is produced in the exposed area of the light-sensitive layer is rapidly blackened to produce a contrast with respect to the unexposed area (background), i.e., to result in the formation of an image.

However, conventional heat-developable photographic materials are not particularly desirable due to the generation of silver which can be seen in white background areas which should be image-free, that is, fog is generated.

The most effective means for reducing the fog, though it is almost impossible to completely prevent the occurrence of fog, is at present, to use the mercury compounds as described in Japanese Patent Publication No. 11113/72 (corresponding to U.S. Pat. No. 3,589,903).

As well known in the art, however, mercury compounds are virulently poisonous, and cannot be employed due to the environmental pollution which is created because, for example, mercury is transpired when the photographic material is submitted to heat-development and, further, the mercury is liable to effuse from the photographic material if it is scrapped after use.

In Japanese Patent Application (OPI) Nos. 119624/75, 120328/75, 70543/81 and 99335/81, etc. there are described that certain organic polyhalogeno compounds are useful as antifoggants for heat-developable photographic materials. However, the antifogging effect obtained with these compounds is much lower than that which is obtained using mercury compounds.

SUMMARY OF THE INVENTION

Therefore, an object of the present invention is to provide a heat-developable photographic material in which fog is prevented from occurring by using a compound having reduced toxicity.

Another object of the present invention is to provide a heat-developable photographic material in which the fog density of the white background after development is reduced.

Other objects of the present invention will become apparent from the following detailed description and examples.

These objects of the present invention are attained with a heat-developable photographic material comprising (a) an organic silver salt, (b) a photocatalyst, (c) a reducing agent, (d) a binder, and (e) at least one compound selected from the compound represented by the general formula (I) described below and the compound represented by the general formula (II) described below.

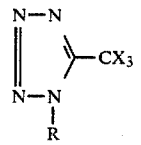

(I)

wherein X represents a halogen atom; and R represents a hydrogen atom, an alkyl group, an aryl group, an aralkyl group, an acyl group, a carbamoyl group, an alkylsulfonyl group, an arylsulfonyl group, an aralkylsulfonyl group or a heterocyclic residue,

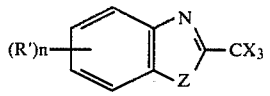

(II)

wherein X represents a halogen atom; Z represents a sulfur atom, an oxygen atom or $>N—R_1$ (wherein $R_1$ represents an alkyl group, an aryl group or an acyl group; (R')n represents a substituent present on the benzene nucleus; and n represents 0 or an integer from 1 to 4.

DETAILED DESCRIPTION OF THE INVENTION

The compounds represented by the general formula (I) or (II) used in the present invention are much lower in toxicity than the mercury compounds described in Japanese Patent Publication No. 11113/72. Furthermore, they have remarkable antifogging effects, compared with conventional organic polyhalogeno compounds known as stabilizers.

The compounds represented by the general formula (I) are described in more detail below.

In the general formula (I), the halogen atom represented by X is a fluorine atom, a chlorine atom, a bromine atom or an iodine atom. Specifically, a chlorine atom and a bromine atom are preferred, and a bromine atom is especially preferred.

Preferable alkyl group represented by R is an alkyl group having from 1 to 18 carbon atoms, with specific examples including a methyl group, an ethyl group, a propyl group, an isopropyl group, an octyl group, a palmityl group and the like.

Preferable aryl group represented by R is a phenyl group and a naphthyl group, and a phenyl group is especially preferred.

Preferable aralkyl group represented by R is an aralkyl group having from 7 to 25 carbon atoms, with specific examples including a phenylmethyl group, a phenylethyl group and the like.

Preferable acyl group represented by R is an acyl group having from 1 to 18 carbon atoms, with specific examples including a formyl group, and an acetyl group, a butanoyl group, an octadecanoyl group, a benzoyl group and the like.

Preferable carbamoyl group represented by R is a carbamoyl group having from 1 to 19 carbon atoms, with specific examples including a carbamoyl group, a methylcarbamoyl group, a dimethylcarbamoyl group, a methylphenylcarbamoyl group, a n-hexadecylcarbamoyl group and the like.

Preferable alkylsulfonyl group, arylsulfonyl group and aralkylsulfonyl group represented by R are those having from 1 to 18 carbon atoms, respectively, with specific examples including a methylsulfonyl group, an ethylsulfonyl group, a butylsulfonyl group, a n-cetylsulfonyl group, a n-octadecylsulfonyl group, a phenylsulfonyl group, a naphthylsulfonyl group, a phenethylsulfonyl group and the like.

Preferable heterocyclic residue is a 5- or 6-membered heterocyclic group which each contains at least one herero atom selected from an oxygen atom, a nitrogen atom and a sulfur atom, and a group of the condensed ring thereof, with specific examples including residues of pyridine, pyrimidine, triazine, tetrazine, pyrrole, imidazole, pyrazole, triazole, oxazole, thiazole, benzimidazole, indole, purine, benzoxazole, benzothiazole, furan, thiophene and the like.

The alkyl group, the aryl group, the aralkyl group, the acyl group, the carbamoyl group, the alkylsulfonyl group, the arylsulfonyl group, the aralkylsulfonyl group or the heterocyclic residue represented by R in the above-described general formula (I) may have one or more substituents. Examples of such substituents include a halogen atom, a hydroxy group, an alkoxyl group, an aryloxy group, an oxycarbonyl group, an oxysulfonyl group, an acyl group, a carboxy group, an acyloxy group, a carbamoyl group, an amino group, an amido group, an alkylsulfonyl group, an arylsulfonyl group, a mercapto group, an alkylthio group, a sulfo group, a sulfamoyl group, a nitro group, a cyano group and the like.

Of the groups represented by R, an alkyl group, an aryl group and an aralkyl group are preferred and particularly preferred groups include a lower alkyl group and a substituted or unsubstituted phenyl group.

Specific examples of the compounds represented by the general formula (I) according to the present invention are set forth below, but the present invention is not to be construed as being limited thereto.

| | |
|---|---|
| (I-1) | 5-Trifluoromethyl-1,2,3,4-tetrazole |
| (I-2) | 5-Tribromomethyl-1,2,3,4-tetrazole |

-continued

| | |
|---|---|
| (I-3) | 1-Octyl-5-tribromomethyl-1,2,3,4-tetrazole |
| (I-4) | 1-(2-Methoxyethyl)-5-trichloromethyl-1,2,3,4-tetrazole |
| (I-5) | 1-(3-Chloropropyl)-5-tribromomethyl-1,2,3,4-tetrazole |
| (I-6) | 1-Phenyl-5-tribromomethyl-1,2,3,4-tetrazole |
| (I-7) | 1-(4-Methoxyphenyl)-5-trichloromethyl-1,2,3,4-tetrazole |
| (I-8) | 1-(4-Chlorophenyl)-5-tribromomethyl-1,2,3,4-tetrazole |
| (I-9) | 1-(2,4,6-Trichlorophenyl)-5-tribromomethyl-1,2,3,4-tetrazole |
| (I-10) | 1-(4-Cyanophenyl)-5-tribromomethyl-1,2,3,4-tetrazole |
| (I-11) | 1-(3-Methanesulfonylphenyl)-5-tribromomethyl-1,2,3,4-tetrazole |
| (I-12) | 1-Benzoyl-5-trichloromethyl-1,2,3,4-tetrazole |
| (I-13) | 1-Methanesulfonyl-5-tribromomethyl-1,2,3,4-tetrazole |
| (I-14) | 1-Ethylphenylcarbamoyl-5-tribromomethyl-1,2,3,4-tetrazole |
| (I-15) | 1-Hexadecanoyl-5-trifluoromethyl-1,2,3,4-tetrazole |
| (I-16) | 1-(4-Methoxyphenylsulfonyl)-5-tribromomethyl-1,2,3,4-tetrazole |
| (I-17) | 1-(4-Pyridyl)-5-tribromomethyl-1,2,3,4-tetrazole |
| (I-18) | 1-(2-Thiazolyl)-5-tribromomethyl-1,2,3,4-tetrazole |
| (I-19) | 1-(2-Benzimidazolyl)-5-tribromomethyl-1,2,3,4-tetrazole |
| (I-20) | 1-(5-Tetrazolyl)-5-tribromomethyl-1,2,3,4-tetrazole |

The compounds represented by the above-described general formula (I) can be easily synthesized with reference to methods for synthesizing known 5-substituted tetrazoles or 1,5-disubstituted tetrazols as described, for example, in Pankaja K. Kadaba, *Synthesis,* vol. 1973, page 71; J. S. Mihina, R. M. Herbst, *Journal of Organic Chemistry,* vol. 15, page 1082 (1950); R. M. Herbst, K. R. Wilson, *Journal of Organic Chemistry,* vol. 22, page 1142 (1957); W. G. Finnegan, R. A. Henry, R. Lofquist, *Journal of American Chemical Society,* vol. 80, page 3908 (1958); W. P. Norris, *Journal of Organic Chemistry,* vol. 27, page 3248 (1962); P. K. Kadaba, *Synthetic Communication,* vol. 1, page 1 (1971); F. R. Benson, *The Tetrazoles, Heterocyclic Compounds,* vol. 8, page 1 (John Wiley & Sons, New York, 1967); F. G. Fallon, R. M. Herbst, *Journal of Organic Chemistry,* vol. 22, page 933 (1957); G. Schroeter, *Chemical Berichte,* vol. 42, page 3356 (1909); P. A. S. Smith, E. Leon, *Journal of American Chemical Society,* vol. 80, page 4647 (1958); J. Vaughan, P. A. S. Smith, *Journal of Organic Chemistry,* vol. 23, page 1909 (1958), etc., as illustrated by the following reaction scheme (1) or (2).

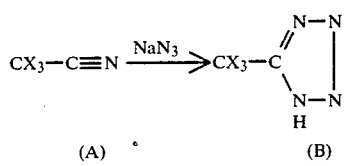

(1)

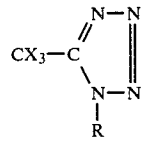

(I)

-continued

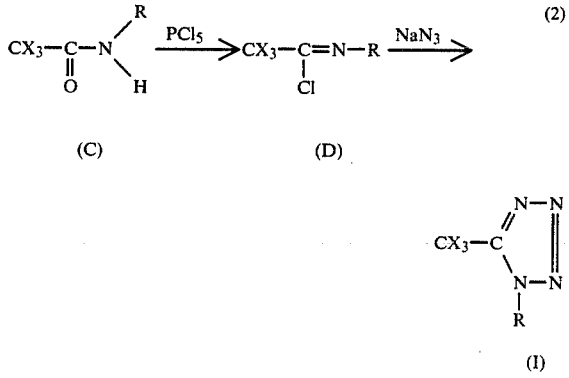

(2)

(C) (D) (I)

In the above formulae, R and X have the same meanings as defined above.

Typical synthesis examples are set forth below.

SYNTHESIS EXAMPLE 1

Synthesis of Compound (I-1)

18.3 g of 5-trifluoromethyl-1,2,3,4-tetrazole was obtained from 22.5 g of tribluoroacetonitrile by the method described in W. P. Norris, *Journal of Organic Chemistry*, vol. 27, page 3248 (1962). A boiling point was 70° to 73° C. at 4 mmHg.

SYNTHESIS EXAMPLE 2

Synthesis of Compound (I-15)

6.9 g of 5-trifluoromethyl-1,2,3,4-tetrazole and 13.7 g of palmitoyl chloride were dissolved in 100 ml of acetonitrile while cooling with ice and to the solution was added dropwise 4.5 ml of pyridine over a period of about 10 minutes. After the completion of the dropwise addition, the mixture was stirred at about 5° C. for 30 minutes and then at room temperature for 1 hour, and to the mixture was added dropwise about 100 ml of ice water. The crystals thus-deposited were collected by filtration to obtain 8.2 g of 1-hexadecanoyl-5-trifluoromethyl-1,2,3,4 -tetrazole. A melting point was 66° to 69° C.

SYNTHESIS EXAMPLE 3

Synthesis of Compound (I-6)

Synthesis of Tribromoacetyl chloride (6a)

A mixture composed of 30 g of tribromoacetic acid, 35 ml of acetonitrile and 30 ml of thionyl chloride was refluxed for 1.5 hours. After removing the acetonitrile and the thionyl chloride by distillation under normal pressure, the residue was subjected to distillation under reduced pressure to obtain 24.6 g of tribromoacetyl chloride. A boiling point was 80° to 81° C./mmHg.

Synthesis of Tribromoacetanilide (6b):

An acetonitrile solution containing 6.51 g of aniline and 8.08 g of triethylamine was stirred while cooling with ice and to the solution was added dropwise 23.75 g of tripromoacetyl chloride. After the completion of the dropwise addition, the mixture was stirred for 1 hour and the reaction solution was poured into 500 ml of water. The crystals thus-deposited were collected by filtration, washed with water and recrystallized from n-hexane to obtain 20.47 g of tribromoacetanilide. A melting point was 97° to 98° C.

Synthesis of 1-Phenyl-5-tribromomethyl-1,2,3,4-tetrazole [Compound (I-6)]

A mixture composed of 14.8 g of tribromoacetanilide and 11.91 g of phosphorus pentachloride was heated at 140° to 150° C. for 2 hours and the resulting phosphorus oxychloride was removed by distillation under reduced pressure. The residue was added little by little to a solution composed of 7.8 g of sodium azide, 9.84 g of sodium acetate, 80 ml of acetone and 20 ml of water with stirring while cooling with ice. After the completion of the addition, the mixture was further stirred under cooling with ice for 30 minutes and the reaction solution was poured into 1 liter of ice water. The crystals thus-deposited were collected by filtration, washed with water and recrystallized from methanol to obtain 6.7 g of the desired compound. A melting point was 141 to 142° C.

In a similar manner, Compounds (I-8), (I-9) and (I-10) have an electron attractive substituent were synthesized.

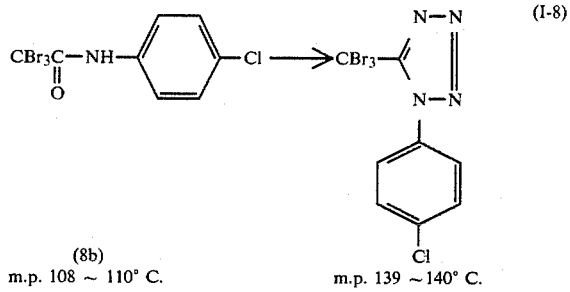

(I-8)

(8b) m.p. 108 ~ 110° C. m.p. 139 ~140° C.

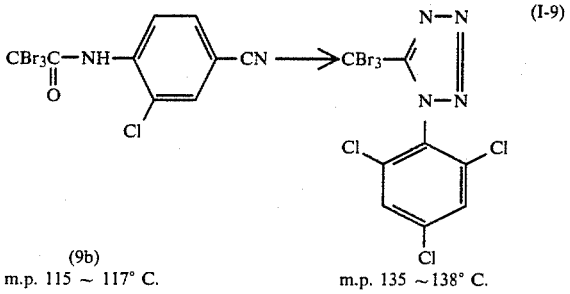

(I-9)

(9b) m.p. 115 ~ 117° C. m.p. 135 ~138° C.

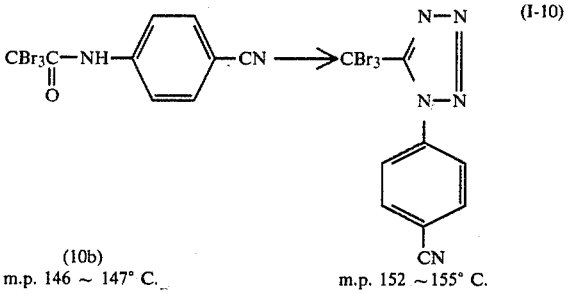

(I-10)

(10b) m.p. 146 ~ 147° C. m.p. 152 ~155° C.

SYNTHESIS EXAMPLE 4

Synthesis of Compound (I-4)

About 13 g of N-(2-methoxyethyl)trichloroacetamide was obtained from 12.7 g of trichloroacetyl chloride and 5.25 g of 2-methoxyethylamine in a similar procedure to the synthesis of Compound (6b) described above. The compound was reacted without further purification with phosphorus pentachloride and then with sodium azide to obtain 11.2 g of 1-(2-methoxyethyl)-5-trichloromethyl-1,2,3,4-tetrazole [Compound (I-4)]. A melting point was 108° to 111° C.

The compounds represented by the general formula (II) are described in more detail below.

In the general formula (II), the halogen atom represented by X is a fluorine atom, a chlorine atom, a bromine atom or an iodine atom. Specifically, a chlorine atom and a bromine atom are preferred, and a bromine atom is especially preferred.

$R_1$ in $>N—R_1$ for Z preferably represents a substituted or unsubstituted alkyl group having from 1 to 18 carbon atoms, a substituted or unsubstituted aryl group having from 6 to 22 carbon atoms, a naphthyl group or a substituted or unsubstituted acyl group having from 2 to 18 carbon atoms.

The antifogging effect is especially large when Z is a sulfur atom or an oxygen atom.

The substituent on the benzene nucleus represented by R' in the general formula (II) includes a halogen atom, a hydroxy group, a carboxy group, a sulfo group, a nitro group, a cyano group, a substituted or unsubstituted alkyl group, an aryl group, an alkoxy group, an aryloxy group, an alkyloxycarbonyl group, an aryloxycarbonyl group, an alkyloxysulfonyl group, an aryloxysulfonyl group, an acyl group, an acyloxy group, a carbamoyl group, an amino group, an amido group, an alkylsulfonyl group, an arylsulfonyl group, a mercapto group, a sulfamoyl group and the like. When n is 2 to 4, the above-described substituents may be the same or different. More preferable antifogging effect is obtained when the compounds having an electron attractive substituent for R' are employed.

Specific examples of the compounds represented by the general formula (II) according to the present invention are set forth below, but the present invention is not to be construed as being limited thereto.

| | |
|---|---|
| (II-1) | 2-Tribromomethylbenzothiazole |
| (II-2) | 5-Chloro-2-tribromomethylbenzothiazole |
| (II-3) | 5,6-Dichloro-2-tribromomethylbenzothiazole |
| (II-4) | 6-Nitro-2-trichloromethylbenzothiazole |
| (II-5) | 5,6-Dimethyl-2-tribromomethylbenzothiazole |
| (II-6) | 5-Methoxycarbonyl-2-trifluoromethylbenzothiazole |
| (II-7) | 6-Methoxy-2-tribromomethylbenzothiazole |
| (II-8) | 5-Phenyl-2-trichloromethylbenzothiazole |
| (II-9) | 5-Acetyl-2-tribromomethylbenzothiazole |
| (II-10) | 2-Trifluoromethylbenzoxazole |
| (II-11) | 2-Tribromomethylbenzoxazole |
| (II-12) | 5-Chloro-6-methyl-2-tribromomethylbenzoxazole |
| (II-13) | 5-Octyl-2-tribromomethylbenzoxazole |
| (II-14) | 6-Phenoxy-2-tribromomethylbenzoxazole |
| (II-15) | 1-Methyl-2-tribromomethylbenzimidazole |
| (II-16) | 5,6-Dichloro-1-ethyl-2-tribromomethylbenzimidazole |
| (II-17) | 1-Methyl-4,5,6,7-tetrachloro-2-tribromomethylbenzimidazole |
| (II-18) | 1-(2-Methoxyethyl)-2-tribromomethylbenzimidazole |
| (II-19) | 6-Chloro-4-nitro-1-(4-sulfobutyl)-2-trichloromethylbenzimidazole |
| (II-20) | 1-Benzoyl-5,6-dichloro-2-tribromomethylbenzimidazole |

The compounds represented by the above-described general formula (II) can be synthesized with reference to known conventional methods for synthesizing benzothiazoles, benzoxazoles and benzimidazoles. More specifically, the compounds can be easily synthesized with reference to method for synthesizing 2-methyl or 2-phenyl derivatives as described, for example, in Beilstein, vol. B27, page 21 and 3 (synthesis of 2-methyl or 2-phenylbenzothiazoles), ibid., page 20, 88, 91 and 117 (synthesis of 2-methyl or 2-phenyl benzoxazoles), ibid., pages 152 and 160 (synthesis of 1-methyl or 2-methylbenzimidazoles); Masaki Ohta, *Dai-Yuki Kagaku*, vol. 15-II, page 146 (Asakura Shoten, 1957) (synthesis of benzothiazoles), ibid., page 45 (synthesis of benzoxazoles), ibid., page 238 (synthesis of benzidazoles); *The Chemistry of Heterocyclic Compounds, Imidazole and its Derivatives*, Part I, page 247 (Interscience Publishers Inc., New York, 1953) (synthesis of benzimidazoles), etc. by condensation reaction of trihalogenoacetic acid or trihalogenoacetyl chloride of the formula (E) with an amino compound of the formula (F), as illustrated by the following reaction scheme (1).

Reaction Scheme (1):

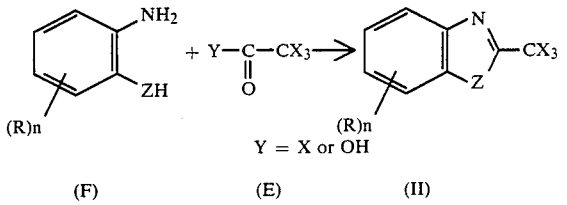

In the above formulae, X, Z and (R)n have the same meanings as defined above. Further, compounds represented by the general formula (II) wherein X is a bromine atom can be easily synthesized by direct bromination of 2-methyl compound of the formula (G), as illustrated by the following reaction scheme (2).

Reaction Scheme (2):

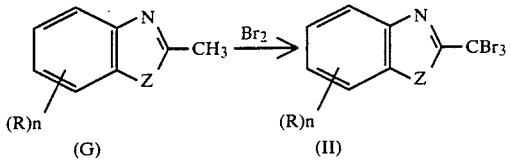

In the above formulae, Z and (R)n have the same meanings as defined above.

Typical synthesis examples are set forth below.

SYNTHESIS EXAMPLE 5

Synthesis of 2-Tribromomethylbenzothiazole [Compound (II-1)]

12.5 g (0.10 mol) of 2-aminothiophenol and 8.7 g (0.11 mol) of pyridine were added to 100 ml of tetrahydrofuran, to which was gradually added dropwise 36 g (0.10 mol) of tribromoacetyl bromide under cooling with ice. After the completion of the dropwise addition, the mixture was stirred at room temperature for 30 minutes and then with heating for 1 hour. The reaction solution was poured into 500 ml of ice water. The precipitate thus-formed was separated by filtration, dried and recrystallized from n-hexane to obtain 11.5 g of Compound (II-1). A melting point was 79° to 80° C.

SYNTHESIS EXAMPLE 6

Synthesis of 2-Tribromomethylbenzothiazole [Compound (II-1)]

An acetic acid solution containing 14.9 g (0.1 mol) of 2-methylbenzothiazole and 41 g (0.5 mol) of sodium acetate was refluxed, to which was added dropwise 48 g (0.3 mol) of bromine. After the completion of the addition, the mixture was refluxed for 1 hour, allowed to cool and poured into 500 ml of ice water. The precipitate thus-formed was collected by filtration, washed with water, dried and recrystallized from n-hexane to obtain 13.4 g of Compound (II-1) as pale brown crystals. A melting point was 79° to 80° C.

SYNTHESIS EXAMPLE 7

Synthesis of 5,6-Dichloro-2-tribromomethylbenzothiazole [Compound (II-3)]

25.6 g Compound (II-3) as pale brown crystals was obtained in the procedures similar to Synthesis Example 6 using 21.8 g (0.1 mol) of 5,6-dichloro-2-methylbenzothiazole as a starting material. A melting point was 103° to 104° C.

SYNTHESIS EXAMPLE 8

Synthesis of 2-Tribromomethylbenzoxazole [Compound (II-11)

6.5 g of Compound (II-11) as pale brown crystals was obtained in the procedures similar to Synthesis Example 6 using 3.3 g (0.1 mol) of 2-methylbenzoxazole as a starting material, and followed by purification using a silica gel column and recrystallization from methanol. A melting point was 90° to 91° C.

SYNTHESIS EXAMPLE 9

Synthesis of 1-Methyl-2-tribromomethylbenzimidazole [Compound (II-15)]

A mixture composed of 15.2 g (0.1 mol) of N-methyl-2-nitroaniline, 24 g of reduced iron, 0.8 g of ammonium chloride, 20 ml of water and 200 ml of isopropanol was stirred with heating at about 100° C. for 30 minutes in a 1 liter 3 necked flask. The reaction solution was filtered and the filtrate was concentrated under reduced pressure to obtain the crude product of N-methylphenylenediamine. The compound was dissolved in 100 ml of tetrahydrofuran, to which was added 8.7 g (0.11 mol) of pyridine and to which was added dropwise 36 g (0.1 mol) of tribromoacetyl bromide under cooling with ice. After the completion of the dropwise addition, the mixture was stirred at room temperature for 1 hour and then under heating on a steam bath for about 2 hours. The reaction solution was poured into about 500 ml of ice water and the crystals thus-deposited were collected by filtration to obtain 10.6 g of Compound (II-15). A melting point was 108° to 112° C.

The amount of above-described compound (component (e)) according to the present invention which is used can be varied depending upon the particular compound used. However, it is preferably used in an amount of from $10^{-5}$ to 1 mol, and more preferably from $10^{-3}$ to $5\times10^{-1}$ mol, per mol of silver.

An organic silver salt which constitutes component (a) to be employed in the present invention is a colorless, a white or a light-colored compound in its ordinary state, but when heated to 80° C. or higher in the presence of an exposed photocatalyst (described hereinafter) it can react with a reducing agent (described hereinafter) to produce silver. Therefore, it functions as the image-forming component in a heat-developable photographic material. Examples of such organic silver salts include silver salts of organic compounds containing imino, mercapto, thion or carboxyl groups in their individual molecules. Specific examples include the following compounds:

(1) Specific examples of the silver salts of imino group-containing organic compounds include silver salts of benzotriazoles, silver salts of phthalazinones, silver salts of benzoxazinediones, silver salts of imidazoles, silver salts of tetraazaindenes, silver salts of pentaazaindenes and the like.

(2) Specific examples of the silver salts of mercapto or thione group-containing organic compounds include silver salts of 2-mercaptobenzoxazoles, silver salts of mercaptooxadiazoles, silver salts of 2-mercaptobenzthiazoles, silver salts of 2-mercaptobenzimidazoles, silver salts of 3-mercapto-4-phenyl-1,2,4-triazoles and the like.

(3) Specific examples of the silver salts of carboxyl group-containing organic compounds include silver salts of aliphatic carboxylic acids, silver salts of aromatic carboxylic acids (e.g., silver benzoate, silver phthalate, silver phenylacetate, silver 4'-n-octadecyloxydiphenyl-4-carboxylate, etc.) and the like.

More detailed specific examples of these organic silver salts and those of other useful organic silver salts are described, for example, in U.S. Pat. Nos. 3,457,075, 3,549,379, 3,785,830, 3,933,507 and 4,009,039, British Pat. No. 1,230,642, and Japanese Patent Application (OPI) Nos. 93139/75, 99719/75, 141222/77 and 36224/78, etc. In the present invention, also, the organic silver salts to be used as component (a) can be properly chosen from these known organic silver salts. For instance, when silver halides or silver-dye light-sensitive complexes are used as a photocatalyst, organic silver salts relatively stable to light are selected from the above-described known ones. Preferable examples of such organic silver salts include silver salts of a long chain aliphatic carboxylic acids containing from 10 to 40, preferably from 18 to 33, carbon atoms, with specific examples including silver laurate, silver myristate, silver palmitate, silver stearate, silver arachidinate, silver behenate, silver lignocerate, silver pentacosanate, silver cerotate, silver heptacosanate silver montanate, silver melissinate, silver laccerate, etc.

These organic silver salts are synthesized according to various known methods as described in, for example, U.S. Pat. Nos. 3,457,075, 3,458,544, 3,700,458, 3,839,049 and 3,960,908, British Pat. No. 1,173,426, Japanese Patent Application (OPI) Nos. 52626/74, 122011/76 and 14122/77, etc. In particular, the synthesis of organic silver salts in the presence of polymers, as described in U.S. Pat. No. 3,700,458 and Japanese Patent Application (OPI) No. 32015/78, or metal-containing compounds, as described in U.S. Pat. No. 3,887,597 and Japanese Patent Application (OPI) No. 13224/74, are preferred, because organic silver salts having improved grain form, grain size and/or photographic properties can be obtained. The polymer is preferably used in an amount of about 0.1 to about 1,000 g, and particularly about 1 to about 500 g, per 1 mol of organic silver salt to be prepared, and the metal-containing compound is preferably used in an amount of about $10^{-6}$ to $10^{-1}$ mol per mol of organic silver salt to be prepared.

Of the organic silver salts prepared as described above, the salts whose grain sizes are about 0.01 micron to about 10 microns, and particularly about 0.1 micron to about 5 microns, in length are employed to advantage.

The organic silver salt to be employed as component (a) in the present invention is coated in an amount reduced to a silver basis ranging from about 0.1 g to about 4 g, and preferably from about 0.2 g to about 2.5 g, per 1 $m^2$ of support. These amounts can provide the proper degree of image density. Namely, when component (a) is used in an amount smaller than the above-described range, the image produced may have insufficient density and, if it is used in an amount larger than the above-described range, an increase in image density cannot be attained and the material is more expensive to produce.

A photocatalyst which can be used as component (b) in the present invention is a substance that when irradiated with electromagnetic radiation, may be converted into or may have an ability of releasing a compound which will catalyze the silver (image) forming reaction, i.e., act as a catalyst for the reaction of an organic silver salt, component (a), and a reducing agent, component (c), only when heated to 80° C. or higher. Accordingly, the photocatalyst functions as a light-sensitive component and a catalytic component for the silver (image) forming reaction in the heat-developable photographic materials. Suitable examples of such a photocatalyst include inorganic photoconductive substances such as zinc oxide, titanium oxide and the like; salts of heavy metals and diazosulfonic acid or diazosulfinic acid which are described in U.S. Pat. No. 3,152,904; and/or light-sensitive silver salts such as light-sensitive complexes of silver and dyes as described in Japanese Patent Publication No. 25498/74, Japanese Patent Application (OPI) No. 4728/71, and U.S. Pat. No. 3,933,507, and light-sensitive silver halide as described in U.S. Pat. No. 3,457,075. The photocatalyst is used in an amount of usually from about 0.001 mol to about 10 mols, and preferably from about 0.01 mol to about 1 mol, per mol of organic silver salt.

Of these photocatalysts, light-sensitive silver halides, e.g., silver chlorlde, silver bromide, silver iodide, silver chlorobromoiodide, silver chlorobromide, silver chloroiodide, silver iodobromide and the mixtures thereof, are used to the greatest advantage in the present invention. A preferable grain size of such a light-sensitive silver halide ranges from about 0.01 micron to about 2 microns, and particularly from about 0.03 micron to about 0.3 micron. A preferable amount of the light-sensitive silver halide used ranges from about 0.001 mol to 0.7 mol, and particularly from about 0.03 mol to about 0.5 mol, per mol of organic silver salt.

The light-sensitive silver halide is prepared in advance in a form of an emulsion, such as the Lippmann's emulsion, the ammonia process emulsion, emulsions ripened with thiocyanate or thioether, etc., using any of methods known in the photographic art, e.g., a single jet method, a double jet method, etc. Then, the thus prepared light-sensitive silver halide is mixed with other components according to the present invention, and introduced into the composition to be employed in the present invention. In order to allow the organic silver salt and the light-sensitive silver halide to come into sufficient contact with each other upon the introduction into the composition, the means of employing as the protective polymer for making the light-sensitive silver halide emulsion particular polymers, other than gelatin, such as polyvinyl acetals as described in U.S. Pat. Nos. 3,706,564, 3,706,565, 3,713,833 and 3,748,143, British Pat. No. 1,362,970, etc.; the means of enzymatically decomposing gelatin contained in the light-sensitive silver halide emulsion, as descrrbed in British Pat. No. 1,354,186; the means of omitting the use of protective polymers by preparing the light-sensitive silver halide grains in the presence of surface active agents, as described in U.S. Pat. No. 4,076,539, or so on can be adopted.

Further, the light-sensitive silver halide to be employed in the present invention can be produced almost simultaneously with the production of the organic silver salt by injecting a silver ion solution into the mixture in which a halogenating agent and an organic silver salt forming component are copresent, as described in British Pat. No. 1,447,454.

Furthermore, the method of acting a light-sensitive silver halide forming component on a previously prepared organic silver salt solution or dispersion, or a sheet material containing an organic silver salt to convert a part of the organic silver salt into the light-sensitive silver halide can also be employed. The thus prepared light-sensitive silver halide effectively contacts the organic silver salt to exhibit a desirable effect. The above-described term light-sensitive silver halide forming component describes a compound capable of forming a light-sensitive silver halide by the reaction with an organic silver salt. The type of compounds which fall under the category of this component and are effective as this component can be judged by the following simple test. That is, the compound to be tested is mixed with an organic silver salt and, optionally, they are heated. Thereafter, the mixture is examined using X-ray diffractiometry as to whether the diffraction peak characteristic to the silver halide is present or not. Examples of light-sensitive silver halide forming components which can be confirmed as being effective by a test as described above include inorganic halogenides, onium halides, halogenated hydrocarbons, N-halogeno compounds and other halogen-containing compounds. Specific examples of such compounds are illustrated in detail in U.S. Pat. Nos. 4,009,039, 3,457,075 and 4,003,749, British Pat. No. 1,498,956 and Japanese Patent Application (OPI) Nos. 27027/78 and 25420/78. Some of these specific examples are described below.

(1) Inorganic halogenides: For example, halogenides represented by MXn (wherein M is H, $NH_4$ or a metal atom; X is Cl, Br or I; and n is 1 when M is H or $NH_4$, and when M is a metal atom n represents the valency of the metal atom. Examples of the metal atom include lithium, sodium, potassium, cesium, magnesium, calcium, strontium, barium, zinc, cadmium, mercury, tin, antimony, chromium, manganese, iron, cobalt, nickel, rhodium, cerium and so on) are effective. In addition, halogen molecules like bromine water are also useful.

(2) Onium halides: Examples include quaternary ammonium halides such as trimethylphenylammonium bromide, cetylethyldimethylammonium bromide, trimethylbenzylammonium bromide and the like; quaternary phosphonium halides such as tetraethylphosphonium bromide and the like; tertiary sulfonium halides such as trimethylsulfonium iodide and the like; and so on.

(3) Halogenated hydrocarbons: Examples include iodoform, bromoform, carbon tetrabromide, 2-bromo-2-methylpropane and the like.

(4) N-halogeno compounds: Examples include N-chlorosuccinimide, N-bromosuccinimide, N-bromophthalimide, N-bromoacetamide, N-iodosuccinimide, N-bromophthalazone, N-bromooxazolinone, N-chlorophthalazone, N-bromoacetanilide, N,N-dibromobenzenesulfonamide, N-bromo-N-methylbenzenesulfonamide, 1,3-dibromo-4,4-dimethylhydantoin N-bromourazole and the like.

(5) Other halogen-containing compounds: For example, they include triphyenylmethyl chloride, triphenylmethyl bromide, 2-bromoacetic acid, 2-bromoethanol, benzophenone dichloride and so on.

The light-sensitive silver halide forming component as described above is used in a stoichiometrically small amount upon the reaction with the organic silver salt. The amount thereof to be used ranges usually from about 0.001 mol to about 0.7 mol, and preferably from about 0.03 to about 0.5 mol, per mol of organic silver salt. Two or more of the compounds described above may be used in combination as the light-sensitive silver halide forming component, provided that the total amount of them is within the above-described range. A reaction temperature, a reaction time, a reaction pressure and other conditions for the process of converting a part of an organic silver salt into a light-sensitive silver halide using the light-sensitive silver halide forming component can be properly selected from their respective wide ranges depending upon the preparation purpose. As a guide, it can be said that the reaction temperature usually ranges from about −20° C. to about 70° C., the reaction time usually ranges from about 0.1 second to about 72 hours, and the reaction pressure is preferably set to atmospheric pressure. In addition, it is preferred to conduct this reaction in the presence of a polymer to be used as a binder described hereinafter. In this case, the polymer is used in an amount of about 0.01 to about 100 parts by weight, preferably about 0.1 to about 10 parts by weight, per 1 part by weight of organic silver salt.

The light-sensitive silver halides prepared using the above-described various methods can be chemically sensitized with, for example, sulfur-containing compounds, gold compounds, platinum compounds, palladium compounds, silver compounds, tin compounds, chromium compounds or the combinations of two or more thereof. Procedures for these chemical sensitizations are described in, for example, U.S. Pat. No. 4,036,650, British Pat. No. 1,518,850, Japanese Patent Application (OPI) Nos. 22430/76, 78319/76 and 81124/76. In addition, in the embodiment of converting a part of an organic silver salt into a light-sensitive silver halide using a light-sensitive silver halide forming component, sensitization can be attained by incorporating low molecular weight amide compounds as described in U.S. Pat. No. 3,980,482 into the reaction system.

The photocatalyst of component (b), especially light-sensitive silver halides, can be spectrally sensitized with various known dyes. Examples of effective spectral sensitizing dyes include cyanine, merocyanine, rhodacyanine, complex (trinuclear, or tetranuclear) cyanine or merocyanine, holopolar cyanine, styryl, hemicyanine, oxonol, hemioxonol and xanthene dyes. Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above-described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malonitrile nucleus and a pyrazolone nucleus. In the above-described cyanine and merocyanine dyes, those having imino groups or carboxyl groups are particularly effective. Practically, the sensitizing dye to be used in the present invention is properly selected from known dyes as described in U.S. Pat. Nos. 3,761,279, 3,719,495 and 3,877,943, British Pat. Nos. 1,466,201, 1,469,117 and 1,422,057, Japanese Patent Application (OPI) Nos. 27924/76 and 156424/75, and so on, and can be located in the vicinity of the photocatalyst according to known methods used in the above-described examples. These spectral sensitizing dyes are used in amounts of about $10^{-4}$ mol to about 1 mol per 1 mol of photocatalyst.

A reducing agent to be employed as component (c) in the present invention has such a property that when heated to 80° C. or higher, it can react with an organic silver salt in the presence of an optically exposed photocatalyst to reduce the organic silver salt, and functions as an image forming redox composition together with the organic silver salt in a heat-developable photographic material. A suitable reducing agent is selected with due regard to the kind and the powers of an organic silver salt to be used in combination therewith. For example, reducing agents having high reducing powers are suitable for the combined use with organic silver salts which are difficult to reduce, and reducing agents which are poor in reducing power are suitable for combined use with organic silver salts liable to be reduced.

Examples of compounds which are generally known as reducing agents employable in heat-developable photographic materials include monophenols, polyphenols having two or more of phenolic groups, mononaphthols, bisnaphthols, polyhydroxybenzenes having two or more of hydroxyl groups, polyhydroxynaphthalenes having two or more of hydroxyl groups, ascorbic acids, 3-pyrazolidones, pyrazolin-5-ones, pyrazolines, phenylenediamines, hydroxylamines, hydroquinone monoethers, hydrooxamic acids, hydrazides, amidoximes, N-hydroxyureas and so on. More specifically, these reducing agents are described, for example, in U.S. Pat. Nos. 3,615,533, 3,679,426, 3,672,904, 3,751,252, 3,782,949, 3,801,321, 3,794,488, 3,893,863, 3,887,376, 3,770,448, 3,819,382, 3,773,512, 3,839,048, 3,887,378, 4,009,039 and 4,021,240, British Pat. No. 1,486,148, Belgian Pat. No. 786,086, Japanese Patent Application (OPI) Nos. 36143/75, 36110/75, 116023/75, 99719/75, 140113/75, 51933/76, 23721/76 and 84727/77, Japanese Patent Publication No. 35851/76, etc. Component (c) of the present invention can be properly chosen from these known reducing agents. It is believed that the simplest way to select the reducing agent consists of the preparation of heat-developable photographic materials using various reducing agents to be examined for reducing powers, and the materials prepared are examined for their photographic properties and thereby relative superiority of these agents are evaluated.

Examples of such reducing agents which are more suitable for combined use with silver salts of aliphatic carboxylic acids among the above-described reducing agents include polyphenols in which two or more of phenol groups are bonded to each other through an alkylene group or sulfur, especially polyphenols in which two or more of phenol groups, which each has an alkyl group (e.g., a methyl group, an ethyl group, a propyl group, a t-butyl group, a cyclohexyl group, etc.) or an acyl group (e.g., an acetyl group, a propionyl group, etc.) at at least one position adjacent to the hydroxy group substituted position, are bonded to each other through an alkylene group or sulfur, with specific examples including 1,1-bis(2-hydroxy-3,5-dimethylphenyl)-3,5,5-trimethylhexane, 1,1-bis(2-hydroxy-3-t-butyl-5-methylphenyl)methane, 1,1-bis(2-hydroxy-3,5-di-t-butylphenyl)methane, 2,6-methylenebis(2-hydroxy-3-t-butyl-5-methylpheynyl)-4-methylphenol, 6,6'-benzylidenebis(2,4-di-t-butylphenol), 6,6'-benzylidene-bis(2-t-butyl-4-methylphenol), 6,6'-benzylidene-bis(2,4-dimethylphenol), 1,1-bis(2-hydroxy-3,5-dimethylphenyl)-2-methylpropane, 1,1,5,5-tetrakis(2-hydroxy-3,5-dimethylphenyl)-2,4-ethylpentane, 2,2-bis(4-hydroxy-3,5-dimethyl)propane, 2,2-bis(4-hydroxy-3,5-di-t-butylphenyl)propane and the like, as described in U.S. Pat. Nos. 3,589,903 and 4,021,249, British Pat. No. 1,486,148, Japanese Patent Application (OPI) Nos. 51933/76, 36110/75, 116023/75 and 84727/77, Japanese Patent Publication No. 35727/76, bis-β-naphthols as described in U.S. Pat. No. 3,672,904 (e.g., 2,2'-dihydroxyl-1,1'-binaphthyl, 6,6'-dibromo-2,2'-dihydroxy-1,1'-binaphthyl, 6,6'-dinitro-2,2'-dihydroxy-1,1'-binaphthyl, bis(2-hydroxy-1-naphthyl)methane, 4,4'-dimethoxy-1,1'-dihydroxy-2,2'-binaphthyl, etc.); and sulfonamidophenols and sulfonamidonaphthols as described in U.S. Pat. No. 3,801,321 (e.g., 4-benzenesulfonamidophenol, 2-benzenesulfonamidophenol, 2,6-dichloro-4-benzenesulfonamidophenol, 4-benzenesulfonamidonaphthol, etc.).

The amount of the reducing agent to be employed in the present invention varies over a wide range depending upon the kind of organic silver salt, the kind of reducing agent and those additives used in combination with them. However, it ranges generally from about 0.05 mol to about 10 mols, preferably from about 0.1 mol to about 3 mols, per mol of organic silver salt. Within the above-described amount range, two or more of the above-described reducing agents may be used in combination.

It is desirable to use additives called a color toning agent, a tone providing agent or an activator toner (called a color toning agent hereinafter) together with the above-described components. A color toning agent participates in the silver (image) forming redox reaction undertaken by an organic silver salt and a reducing agent, and functions so as to impart dark color, especially black color, to the image produced. A large number of different kinds of compounds are known as color toning agents. Most of such compounds have an imino group, a mercapto group or a thione group. From these compounds, a suitable color toning agent is selected depending upon the kinds of the organic silver salt and the reducing agent used. Examples of color toning agents which can provide desirable toning effects in the present invention include phthalazinones as described in U.S. Pat. Nos. 3,152,904, 3,844,797 and 4,076,534 (e.g., phthalazinone, 2-acetylphthalazinone, 2-carbamoylphthalazinone, etc.); 2-pyrazolin-5-ones (e.g., 3-methyl-2-pyrazolin-5-one, etc.) and quinazolinones (e.g., quinazolinone, 4-methylquinazolinone, etc.) as described in U.S. Pat. No. 3,846,136; pyrimidines (e.g., 6-methyl-2,4-dihydroxypyrimidine, etc.) and 1,2,5-triazines (e.g., 3-methyl-4,6-dihydroxy-1,2,5-triazine, etc.) as described in U.S. Pat. No. 4,030,930; phthalazinediones (e.g., phthalazinedione, etc.) as described in Japanese Patent Publication No. 36774/78; cyclic imides (e.g., succinimides, phthalimides and urazoles as described in U.S. Pat. No. 3,846,136, Japanese Patent Application (OPI) No. 55115/78; benzoxazinediones as described in U.S. Pat. Nos. 3,951,660 and 3,885,967; benzothiazinediones as described in Japanese Patent Application (OPI) No. 76020/78; and naphthalimides as described in U.S. Pat. No. 3,782,941) and other imino group-containing heterocyclic compounds. These color toning agents may be used in combination with two or more thereof. For example, as d.escribed in Japanese Patent Application (OPI) Nos. 1020/78 and 55115/78, combined use of phthalazinones with benzoxazinediones, benzothiazinediones or phthalimides can prevent the occurrence of deterioration of the color toning effect due to storage under high temperature and high humidity.

In addition, combinations of phthalic acid, naphthoic acid or phthalamic acid with imidazoles or phthalazines can be also employed as a color toning agent, as described in U.S. Pat. Nos. 3,847,612 and 3,994,732.

The color toning agent is used in a suitable amount of from about 0.0001 mol to about 2 mols, and more particularly from about 0.0005 moi to about 1 mol, per mol of organic silver salt.

Furthermore, color tones of the images formed are much more improved by employing mercaptotetrazoles (e.g., 5-mercaptotetrazole, 1-phenyl-5-mercaptotetrazole, etc.), precursor of mercaptotetrazoles as described in U.S. Pat. Nos. 3,311,474, 3,993,661, etc. (e.g., 1-phenyl-5-(p-methylphenylsulfonylthio)tetrazole, etc.), 5-substituted-2-mercaptooxadiazoles (e.g., 5-methyl-2-mercaptooxadiazole, etc.), 5-substituted-2-mercaptothiadiazoles (e.g., 5-methyl-2-mercaptothiadiazole, etc.), 5-substituted-3-mercapto-1,2,4-triazoles (e.g., 4,5-diphenyl-3-mercapto-1,2,4-triazole, etc.), disulfides (e.g., di(1-phenyl-5-tetrazolyl)disulfide, etc.) in an amount of from $10^{-4}$ mol to 2 mols per mol of organic silver salt.

Compounds effective for preventing color changes of processed materials from occurring in their white areas due to exposure to light, which are known in the art, may be used together with the components constituting the heat-developable photographic material of the present invention. Suitable examples of such compounds include stabilizer precursors such as azole thioethers and blocked azole thiones, as described in U.S. Pat. No. 3,839,041; tetrazolyl compounds and their precursors as described in U.S. Pat. No. 3,700,457; halogen-containing compounds as described in U.S. Pat. Nos. 3,707,377, 3,874,946, 3,955,982 and 4,108,665; elemental sulfur and sulfur-containing compounds as described in U.S. Pat. No. 4,036,650; and so on. These compounds may be used in combination with two or more thereof.

Further, known heat fog inhibitors may be used together with component (e) of the present invention. Examples of known heat fog inhibitors which can be employed include mercury compounds as described in U.S. Pat. No. 3,589,903; N-halogeno compounds as described in U.S. Pat. No. 3,957,493; benzenethiosulfonic acids as described in Japanese Patent Application (OPI) No. 78227/76; cerium compounds as described in Japanese Patent Application (OPI) No. 24520/77; and other heat fog inhibitors as described in Japanese Patent Application (OPI) Nos. 101019/75, 116024/75, 123331/75, 134421/75, 47419/76, 42529/76, 51323/76, 57435/76, 104338/76, 32015/78, 22431/76, 54428/76, 75433/76, 122430/76, 1020/78, 19825/78 and 28417/78. These inhibitors may be used individually or in combination.

In the case of photographic materials containing silver sulfide (e.g., photographic materials containing silver halide sensitized with sulfur compounds), it is observed that the stabilizers of the tetraazaindene type function so as to depress slight increase in image density due to the presence of silver sulfide which proceeds slowly over a long period, while they usually have no effect on heat-developable photographic materials. For this purpose, for example tetraazaindenes as described in T. H. James, *The Theory of The Photographic Process*, 4th Ed., pp. 398–399, Macmillan Publishing Co. Inc., New York, etc. can be used.

Further, not only mercapto compounds and thioether compounds as described in Japanese Patent Application (OPI) Nos. 70543/81 and 99353/81, but also disulfides and polysulfides may be used in combination with the antifogging agent according to the present invention.

Every component to be employed in the present invention is dispersed in at least one colloid acting as a binder of component (d). Suitable examples of the binder are hydrophobic macromolecular materials. However, hydrophilic macromolecular materials may be used in combination with hydrophobic ones, or independently under certain circumstances. Macromolecular materials which can provide transparent or translucent and colorless, white or light-colored layers or films when coated or spread are preferably employed as the binder. Examples of such materials include natural polymers such as proteins like gelatin, polysaccharides like cellulose derivatives and dextran, gum arabic and so on; and synthetic polymers as described in U.S. Pat. No. 4,009,039, Japanese Patent Application (OPI) Nos. 126408/75, 29126/76, 19525/76 and 84443/74. Among these polymers, polyvinyl butyral, polyvinyl acetate, ethyl cellulose, vinylidene chloride-vinyl chloride copolymer, polymethylmethacrylate, vinyl chloride-vinyl acetate copolymer, cellulose acetate butyrate, gelatin and polyvinyl alcohol are particularly advantageous. Optionally, these polymers may be used in combination of two or more thereof. Such a polymer is used in an amount sufficient to carry the components dispersed therein, that is, within an effective range for the action as the binder. The effective range can be appropriately determined by one skilled in the art. As a guide in the case of carrying at least an organic silver salt, it can be said that a preferable ratio of the binder to the organic silver salt ranges from about 10:1 to 1:10, and particularly from about 4:1 to 1:4, by weight.

When the binder is used to provide a selfsupporting film, a composition containing components to be employed in the present invention may be molded using a known spreading process in the form of a film which carries all the components. However, it is more preferable to coat the composition on a support chosen from various kinds of materials in a form of single layer or multilayer to complete it as a heat-developable photographic material. Specific examples of such a support include various kinds of polymer materials, glass, wool cloth, cotton cloth, paper, metals (e.g., aluminium) and so on. Among these materials, materials capable of being worked upon a flexible sheet or roll are particularly preferable for the application to information recording materials from the handling point of view. Most suitable examples of the support in the present invention include plastic films (e.g., a cellulose acetate film, a polyester film, a polyethylene terephthalate film, a polyamide film, a polyimide film, a triacetate film and a polycarbonate film), and papers (e.g., plain paper, photographic raw paper, printing raw papers such as coated paper and art paper, baryta paper, resin-coated paper, paper sized with polysaccharide as described in Belgian Pat. No. 784,615; pigment paper containing pigment like titanium dioxide, and paper sized with polyvinyl alcohol).

In the heat-developable photographic material of the present invention, various kinds of auxiliary layers, e.g., a metal evaporated layer as described in U.S. Pat. No. 3,748,137; a backing layer as described in British Pat. No. 1,507,991, Japanese Patent Application (OPI) Nos. 43130/76 and 129220/76; a backing layer containing a magnetic material as described in Japanese Patent Application (OPI) No. 136099/75; an antistatic layer; and a subbing layer as described in Japanese Patent Application (OPI) No. 87721/78 can be coated. Further, it is of great advantage to provide an overcoating polymer layer, as described in U.S. Pat. Nos. 3,933,508, 3,856,526, 3,856,527 and 3,893,860, because it can bring good results in that the transparency of each layer provided on the support is heightened, and moisture proofing characteristics or heat resisting characteristics are improved. A suitable thickness of the overcoating polymer layer ranges from about 1 micron to about 20 microns. Suitable examples of the polymer for the overcoating layer include those described in each specification cited above as the polymers for the overcoating polymer layer. Among such polymers, polyvinyl chloride, polyvinyl acetate, vinyl chloride-vinyl acetate copolymer, polystyrene, methyl cellulose, ethyl cellulose, cellulose acetate butyrate, vinyl chloridevinylidene chloride copolymer, carboxylic acid esters, cellulose diacetate, polyvinylidene chloride, polycarbonate, gelatin, polyvinyl alcohol and so on are particularly preferable.

In the layer or the film containing the components of the present invention, or each of the auxiliary layers, additives known in the art of heat-developable photographic materials, for example, a plasticizer, a matting agent, a surface active agent, a sensitizer, a brightening agent, a light absorbing substance, a filter dye, an antihalation dye, a color coupler, a hardener, a lubricant, a development accelerating agent, a stabilizer and so on, can be incorporated. Specific compounds and embodiments of these additives are described in *Product Licensing Index*, vol. 92, No. 9232, pp. after 107 (Dec. 1971), Japanese Patent Application (OPI) Nos. 33615/78, 119623/75, 57619/75 and 27923/76, U.S. Pat. Nos. 3,769,019, 3,821,001, 3,667,959, 3,871,887, 3,885,965, 4,021,250, 4,036,650, 3,531,286 and 3,764,328.

Processes for preparing the heat-developable photographic materials of the present invention are roughly illustrated below. An organic silver salt prepared using one of the known methods is optionally washed with water, an alcohol or the like and then mixed with a photocatalyst to make a mixture in which both are present in a close contact state. In another way, a photocatalyst and an organic silver salt may be produced at the same time. In the most preferable way, a part of an organic silver salt is converted into silver halide using a silver halide forming component. When using sensitizing dyes, it is preferable to add the sensitizing dyes in the form of a solution after the above-described mixing step to the resulting mixture. The mixture of the organic silver salt and the photocatalyst is desirably prepared in the form of polymer dispersion dispersed in a solution of a polymer which can function as the binder afterward. This polymer can be added in any of the steps, such as the step of preparing the organic silver salt, the step of mixing with the photocatalyst, the step of preparing the photocatalyst, or so on. The polymer dispersion of the organic silver salt and the photocatalyst is formed in a film or coated in a layer on a support, and other components of the present invention may be incorporated into a layer provided on tnat film or that layer. More preferably, other components to be employed in the present invention, i.e., at least a reducing agent and component (e) of the present invention, are added to the above-described polymer dispersion of the organic silver salt and the photocatalyst to prepare a heat-developable photographic composition, and the resulting composition is spread into a film or coated in a layer on a support using a known method. When coating the composition, various kinds of coating methods, for example, a dip coating method, an air knife coating, a curtain coating method, a hopper coating method and so on, can be employed. In addition, various kinds of auxiliary layers, for example, a subbing layer, an overcoating layer and so on, can be optionally coated on prior to, simultaneously with or subsequently to the coating of the heat-developable photographic composition using a similar method to one of the above-described methods.

Solvents to be used for the coating solutions may be appropriately selected. For instance, noncombustible solvents as described in British Pat. No. 1,422,145 can be used.

Optionally, printing can be carried out on the surface or the back of the support, or on a layer provided on the support. Therefore, the materials of the present invention on which prescribed patterns are printed can be applied to a (season) ticket, a post card and other correspondence.

The thus prepared heat-developable photographic material is cut in a size suitable for use, and subjected to imagewise exposure. Preheating (80° C. to 140° C.) may be carried out prior to the exposing step, if necessary. Suitable light sources for imagewise exposure include a tungsten lamp, a fluorescent lamp for a copier as used mainly for exposure of diazo type light-sensitive materials, a mercury lamp, an iodine lamp, a xenon lamp, a cathode ray tube (CRT) light source, a laser light source and so on. As for an original, not only line images like drafting, but also photographic images having gradation and, further, a person or a landscape photographed with a camera can be employed. Printing may be carried out using a contact printing method where original is superposed directly on the photographic material, or using a reflection printing method or an enlarging printing method. A suitable exposure amount is determined depending upon the sensitivity of the photographic material used. It is about 1 lux·sec in the case of high-speed photographic materials, and about $10^3$ lux·sec in the case of low-speed ones. The thus imagewise exposed photographic material can be developed only by heating (a temperature higher than about 80° C., and preferably ranging from about 100° C. to about 150° C.). The heating time is adjusted to an appropriate value within the range of from 1 sec to 60 sec or so. It is preferably determined depending upon the heating temperature adopted. Usually, about 5 sec to about 40 sec are suitable for 120° C., about 2 sec to about 20 sec for 130° C., and about 1 sec to about 10 sec for 140° C. Heating may be carried out using various means. For example, the photographic material may be simply made to come into contact with a hot plate or drum, or may be made to pass through a heated space as circumstances require. Further, a high frequency wave-induced heating means, or a laser beam-induced heating means may be adopted.

The present invention will now be illustrated in more detail with reference to the following examples, but the present invention should not be construed as being limited thereto.

EXAMPLE 1

A polymer dispersion of a silver salt was prepared by dispersing a composition comprised of the following components by means of a homogenizer.

| Composition of Polymer Dispersion: | |
|---|---|
| Silver Behenate | 76 g |
| Polyvinyl Butyral | 80 g |
| Isopropyl Alcohol | 200 g |
| n-Butyl Acetate | 200 g |

The resulting polymer dispersion was maintained at 50° C. and thereto, a solution of 4 g of N-bromosuccinimide in 100 ml of acetone was added and heated for a period of 90 minutes to convert a part of the silver behenate into silver bromide.

The thus prepared silver behenate-silver bromide polymer dispersion was maintained at 40° C. and thereto were added the following volumes of ingredients in their order of description to prepare a coating solution:

| | |
|---|---|
| Reducing agent of the following formula (16 wt % of acetone solution) 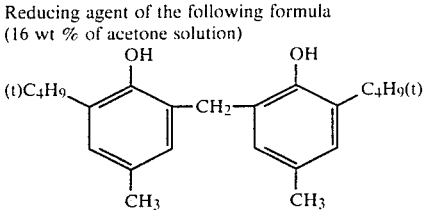 | 140 ml |
| Sensitizing dye of the following formula (0.1 wt % of ethylene glycol monomethyl ether solution) 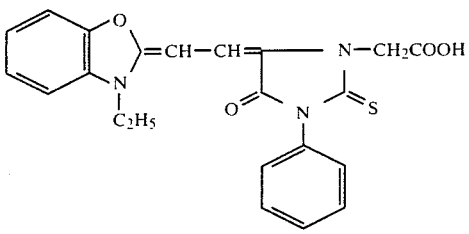 | 35 ml |
| Phthalazinone (16 wt % of ethylene glycol monomethyl ether solution) | 140 ml |
| 1-Phenyl-5-tribromomethyl-1,2,3,4-tetrazole [Compound (I-6)] (1 wt % acetone solution) | 100 ml |
| Hexamethylenediisocyanate (1 wt % n-butyl acetate solution) | 40 ml |

The thus prepared coating solution was coated on photographic raw paper so as to have a coverage of 0.4 g silver per square meter, and dried. Further, a 2 wt % of acetone solution of cellulose diacetate was coated as an overcoating layer so as to have a coverage of 0.4 g polymer per square meter. The thus obtained heat-developable photographic material was designated Sample A-1.

Heat-developable photographic materials were prepared in the same manner as described in Sample A-1 except that 100 ml of a 1 wt % acetone solution of Compounds (I-1), (I-2), (I-4), (I-8), (I-9), (I-10), (I-13), (I-14) and (I-17), respectively, was used in place of the addition of Compound (I-6). These materials were designated Samples A-2 to A-10, respectively.

For the purpose of comparison, a comparative material "Sample B-1" was prepared in the same manner as described in Sample A-1 except that the compound according to the present invention was not added.

Further, another comparative material "Sample B-2" was prepared in the same manner as described in Sample A-1 except that 100 ml of a 1 wt % of methyl ethyl ketone solution of tribromoacetophenone was added in place of the addition of the compound according to the present invention. Still another comparative material "Sample B-3" was prepared in the same manner as described in Sample A-1 except that 40 ml of a 1 wt % methanol solution of mercuric acetate was added in place of the addition of the compound according to the present invention.

Each of these materials was exposed to light through an optical wedge in an exposure of $10^3$ lux·sec and then heated at a temperature of 120° C. for 10 seconds to produce a black image. Reflection density of each of the thus produced images was measured. The sensitivity was determined by measuring a reciprocal of the exposure amount required for obtaining a reflection density of fog value +0.1. The results obtained are shown in Table 1 as relative values of Sample B-3 taken as 100. In addition, data of heat fog and maximum density obtained are also shown in Table 1.

TABLE 1

| Sample | Compound | Relative Sensitivity | Heat Fog | Maximum Density |
|---|---|---|---|---|
| A-1 | (I-6) | 95 | 0.09 | 1.30 |
| A-2 | (I-1) | 100 | 0.22 | 1.35 |
| A-3 | (I-2) | 96 | 0.10 | 1.30 |
| A-4 | (I-4) | 98 | 0.14 | 1.36 |
| A-5 | (I-8) | 96 | 0.08 | 1.30 |
| A-6 | (I-9) | 93 | 0.09 | 1.28 |
| A-7 | (I-10) | 93 | 0.10 | 1.32 |
| A-8 | (I-13) | 94 | 0.11 | 1.35 |
| A-9 | (I-14) | 98 | 0.12 | 1.35 |
| A-10 | (I-17) | 98 | 0.11 | 1.33 |
| B-1 | Blank | 110 | 0.69 | 1.40 |
| B-2 | Known Polyhalogeno Compound | 105 | 0.55 | 1.35 |
| B-3 | Known Mercury Compound | 100 | 0.08 | 1.35 |

It is apparent from the results shown in Table 1 that Samples A-1 to A-10 according to the present invention had a very large heat fog preventing effect and showed small decreases in the sensitivity and the maximum density, in comparison with the comparative samples B-1 and B-2, and that, there was slight differences in the photographic properties between sample A-1 to A-10 and the comparative sample B-3 in which the mercury compound was used. Further, when Samples A-1 to A-10 according to the present invention were all stood on a sharcasten for one hour, no increase in fog at the white background was caused. Furthermore, when Samples A-1 to A-10 according to the present invention were allowed to stand for 3 days in the dark under the condition of 50° C., 70% RH, an increase in fog at the white background was hardly observed. These results clearly show that heat-developable photographic materials having extremely reduced heat fog are provided according to the present invention.

EXAMPLE 2

A polymer dispersion of a silver salt was prepared by dispersing a composition comprised of the following components by means of a homogenizer.

| Composition of Polymer Dispersion: | |
|---|---|
| Silver Behenate | 76 g |
| Polyvinyl Butyral | 80 g |
| Isopropyl Alcohol | 200 g |
| n-Butyl Acetate | 200 g |

The resulting polymer dispersion was maintained at 50° C. and thereto, a solution of 4 g of N-bromosuccinimide in 100 ml of acetone was added and heated for a period of 90 minutes to convert a part of the silver behenate into silver bromide.

The thus prepared silver behenate-silver bromide polymer dispersion was maintained at 40° C. and thereto were added the following volumes of ingredients in their order of description to prepare a coating solution:

Reducing agent of the following formula (16 wt % of acetone solution) — 140 ml

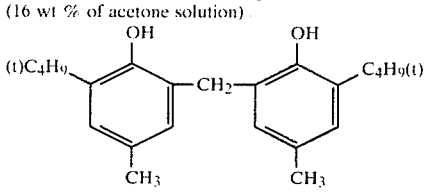

Sensitizing dye of the following formula (0.1 wt % of ethylene glycol monomethyl ether solution) — 35 ml

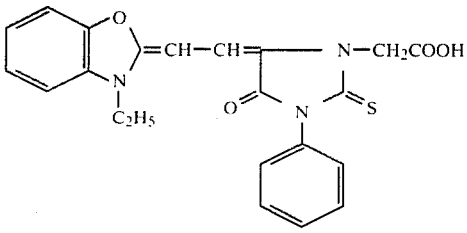

| | |
|---|---|
| Phthalazinone (16 wt % of ethylene glycol monomethyl ether solution) | 140 ml |
| 2-Tribromomethylbenzothiazole [Compound (II-1)] (1 wt % acetone solution | 100 ml |
| Hexamethylenediisocyante (1 wt % n-butyl acetate solution) | 40 ml |

The thus prepared coating solution was coated on photographic raw paper so as to have a coverage of 0.4 g silver per square meter, and dried. Further, a 2 wt % of acetone solution of cellulose diacetate was coated as an overcoating layer so as to have a coverage of 0.4 g polymer per square meter. The thus obtained heat-developable photographic material was designated Sample E-1.

For the purpose of comparison, a comparative material "Sample F-1" was prepared in the same manner as described in Sample E-1 except that 2-tribromomethylbenzothiazole [Compound (II-1)] was not added.

Further, another comparative material "Sample F-2" was prepared in the same manner as described in Sample E-1 except that 40 ml of a 1 wt % methanol solution of mercuric acetate was added in place of the addition of 2-tribromomethylbenzothiazole [Compound (II-1)].

Each of these materials was exposed to light through an optical wedge in an exposure of $10^3$ lux·sec and then heated at a temperature of 120° C. for 10 seconds to produce a black image. Reflection density of each of the thus produced images was measured. The sensitivity was determined by measuring a reciprocal of the exposure amount required for obtaining a reflection density of fog value +0.1. The results obtained are shown in Table 2 as relative values of Sample F-2 taken as 100. In addition, data of heat fog and maximum density obtained are also shown in Table 2.

TABLE 2

| Sample | Relative Sensitivity | Heat Fog | Maximum Density |
|---|---|---|---|
| E-1 | 95 | 0.11 | 1.25 |
| F-1 | 115 | 0.80 | 1.40 |
| F-2 | 100 | 0.10 | 1.35 |

It is apparent from the results shown in Table 2 that Sample E-1 according to the present invention had a very large heat fog preventing effect and showed small decreases in the sensitivity and the maximum density, in comparison with the comparative sample F-1, and that, there was slight differences in the photographic properties between Sample E-1 and the comparative Sample F-2 in which the mercury compound was used. Further, when Sample E-1 according to the present invention was stood on a sharcasten for one hour, no increase in fog at the white background was caused. Furthermore, when Sample E-1 according to the present invention was allowed to stand for 3 days in the dark under the condition of 50° C., 70% RH, an increase in fog at the white background was hardly observed.

EXAMPLE 3

Heat-developable photographic materials were prepared in the same manner as described in Sample E-1 of Example 2 except that the compounds set forth in Table 3, respectively, were used in place of 2-tribromomethylbenzothiazole [Compound (II-1)]. These materials were designated Samples E-2 to E-9, respectively.

TABLE 3

| Sample | Compound Used |
|---|---|
| E-2 | 5,6-Dichloro-2-tribromomethylbenzothiazole [Compound (II-3)] |
| E-3 | 5,6-Dimethyl-2-tribromomethylbenzothiazole [Compound (II-5)] |
| E-4 | 5-Phenyl-2-trichloromethylbenzothiazole [Compound (II-8)] |
| E-5 | 5-Acetyl-2-tribromomethylbenzothiazole [Compound (II-9)] |
| E-6 | 2-Trifluoromethylbenzoxazole [Compound (II-10)] |
| E-7 | 2-Tribromomethylbenzoxazole [Compound (II-11)] |
| E-8 | 1-Methyl-2-tribromomethylbenzimidazole [Compound (II-15)] |
| E-9 | 5,6-Dichloro-1-ethyl-2-tribromomethylbenzimidazole [Compound (II-16)] |

The results of sensitometry with these samples carried out in the same manner as described in Example 2 a e shown in Table 4.

TABLE 4

| Sample | Relative Sensitivity | Heat Fog | Maximum Density |
|---|---|---|---|
| E-2 | 95 | 0.09 | 1.25 |
| E-3 | 100 | 0.12 | 1.30 |

TABLE 4-continued

| Sample | Relative Sensitivity | Heat Fog | Maximum Density |
|---|---|---|---|
| E-4 | 101 | 0.18 | 1.35 |
| E-5 | 94 | 0.09 | 1.24 |
| E-6 | 104 | 0.32 | 1.38 |
| E-7 | 95 | 0.11 | 1.25 |
| E-8 | 100 | 0.12 | 1.26 |
| E-9 | 97 | 0.15 | 1.29 |

The data shown in Table 4 clearly show that heat-developable photographic materials having very reduced heat fog prepared in accordance with the present invention.

While the invention has been described in detail and with reference to specific embodiments thereof, it will be apparent to one skilled in the art that various changes and modifications can be made therein without departing from the spirit and scope thereof.

What is claimed is:

1. A heat-developable photographic material comprising (a) an organic silver salt, (b) a photocatalyst, (c) a reducing agent, (d) a binder, and (e) at least one compound represented by the general formula (I):

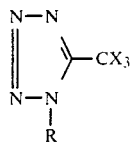

(I)

wherein X represents a halogen atom and R represents a hydrogen atom, an alkyl group, an aryl group, an aralkyl group, an acyl group, a carbamoyl group, a alkysulfonyl group, an arylsulfonyl group, an aralkylsulfonyl group or a heterocyclic residue.

2. A heat developable photographic material as claimed in claim 1, wherein the halogen atom represented by X is a chlorine atom or a bromine atom.

3. A heat-developable photographic material as claimed in claim 1, wherein the halogen atom represented by X is a bromine atom.

4. A heat-developable photographic material as claimed in claim 1, wherein the alkyl group represented by R is an alkyl group containing from 1 to 18 carbon atoms.

5. A heat-developable photographic material as claimed in claim 1 wherein the aryl group represented by R is a phenyl group or a naphthyl group.

6. A heat-developable photographic material as claimed in claim 1, wherein the aryl group represented by R is a phenyl group.

7. A heat-developable photographic material as claimed in claim 1, wherein the aralkyl group represented by R is an aralkyl group containing from 7 to 25 carbon atoms.

8. A heat-developable photographic material as claimed in claim 1, wherein the acyl group represented by R is an acyl group containing from 1 to 18 carbon atoms.

9. A heat-developable photographic material as claimed in claim 1, wherein the carbamoyl group represented by R is a carbamoyl group containing from 1 to 19 carbon atoms.

10. A heat-developable photographic material as claimed in claim 1, wherein the alkylsulfonyl group represented by R is an alkylsulfonyl group containing 1 to 18 carbon atoms.

11. A heat-developable photographic material as claimed in claim 1, wherein the heterocyclic residue represented by R is a 5- or 6-membered heterocyclic group each of which contains at least one hetero atom selected from an oxygen atom, a nitrogen atom and a sulfur atom, or a group of the condensed ring thereof.

12. A heat-developable photographic material as claimed in claim 1, wherein the alkyl group, the aryl group, the aralkyl group, the acyl group, the carbamoyl group, the alkylsulfonyl group, the arylsulfonyl group, the aralkylsulfonyl group or the heterocyclic residue represented by R has one or more substituents selected from a halogen atom, a hydroxy group, an alkoxyl group, an aryloxy group, an oxycarbonyl group, an oxysulfonyl group, an acyl group, a carboxy group, an acyloxy group, a carbamoyl group, an amino group, an amido group, an alkylsulfonyl group, an arylsulfonyl group, a mercapto group, an alkylthio group, a sulfo group, a sulfamoyl group, a nitro group, and a cyano group.

13. A heat-developable photographic material as claimed in claim 1, wherein R is an alkyl group, an aryl group or an aralkyl group.

14. A heat-developable photographic material as claimed in claim 1, wherein R is a lower alkyl group or a substituted or unsubstituted phenyl group.

15. A heat-developable photographic material as claimed in claim 1, wherein the compound represented by the general formula (I) is present in an amount of from $10^{-5}$ to 1 mol per mol of silver.

16. A heat-developable photographic material as claimed in claim 15, wherein the compound represented by the general formula (I) is present in an amount of $10^{-3}$ to $5\times10^{-1}$ mol per mol of silver.

17. A heat-developable photographic material as claimed in claim 1, wherein the organic silver salt is a silver salt of an organic compound containing an imino group, a mercapto group, a thione group or a carboxyl group.

18. A heat-developable photographic material as claimed in claim 17, wherein the organic silver salt is a silver salt of a long chain aliphatic carboxylic acid containing from 10 to 40 carbon atoms.

19. A heat-developable photographic material as claimed in claim 1, wherein the organic silver salt is present in an amount reduced to a silver bases ranging from 0.1 g to 4 g/m$^2$.

20. A heat-developable photographic material as claimed in claim 1, wherein the photocatalyst is present in an amount of 0.001 mol to 10 mol per mol of organic silver salt.

21. A heat-developable photographic material as claimed in claim 1, wherein the photocatalyst is a light-sensitive silver halide.

22. A heat-developable photographic material as claimed in claim 21, wherein the light-sensitive silver halide is present in an amount of 0.001 mol to 0.7 per of organic silver salt.

23. A heat-developable photographic material as claimed in claim 21, wherein the light-sensitive silver halide is a light-sensitive silver halide which is formed by the reaction of an organic silver salt with a light-sensitive silver halide forming component to convert a part of the organic silver salt into the light-sensitive silver salt.

24. A heat-developable photographic material as claimed in claim 23, wherein the light-sensitve silver halide forming component is an inorganic halide, an onium halide, a halogenated hydrocarbon, a N-halogeno compound or a halogen-containing compound.

25. A heat-developable photographic material as claimed in claim 1, wherein the reducing agent is a monophenol, a polyphenol having two or more of phenolic groups, a mononaphthol, a bisnaphthol, a polyhydroxybenzene having two or more of hydroxy groups, a polyhydroxynaphthalene having two or more of hydroxy groups, an ascorbic acid, a 3-pyrazolidone, a pyrazolin-5-one, a pyrazoline, a phenylenediamine, a hydroxylamine, a hydroquinone monoether, a hydrooxamic acid, a hydrazide, an amidoxime or a N-hydroxyurea.

26. A heat-developable photographic material as claimed in claim 25, wherein the reducing agent is a polyphenol in which two or more phenol groups, which each has an alkyl group or an acyl group at least one position adjacent to the hydroxy group substituted position, are bonded to each other through an alkylene group or sulfur.

27. A heat-developable photographic material as claimed in claim 1, wherein the recucing agent is present in an amount of 0.05 mol to 10 mol per mol of organic silver salt.

28. A heat-developable photographic material as claimed in claim 1, wherein the binder is a hydrophobic macromolecular material or a hydrophilic macromolecular material.

29. A heat-developable photographic material as claimed in claim 1, wherein the ratio of the binder to the organic silver salt ranges from 10:1 to 1:10 by weight.

30. A heat-developable photographic material as claimed in claim 1, wherein the organic silver salt, the photocatalyst, the reducing agent, the binder and the compound represented by the general formula (I) are coated on a support.

31. A heat-developable photographic material as claimed in claim 1, wherein the photographic material further comprises an overcoating polymer layer.

* * * * *